United States Patent [19]

Laidlaw

[11] Patent Number: 4,841,641

[45] Date of Patent: Jun. 27, 1989

[54] CHAIN SAW SAFETY STRUCTURE

[76] Inventor: Gerry A. Laidlaw, 6816 Barber Pl., NE., Albuquerque, N. Mex. 87109

[21] Appl. No.: 156,465

[22] Filed: Feb. 16, 1988

[51] Int. Cl.[4] ..... B27B 17/02

[52] U.S. Cl. ..... 30/382; 30/296 R

[58] Field of Search ..... 30/286, 296 R, 381, 30/382, 383, 384

[56] References Cited

U.S. PATENT DOCUMENTS

| | | | |
|---|---|---|---|
| 595,438 | 12/1897 | Hall . | |
| 938,105 | 10/1909 | Ziegler . | |
| 1,497,135 | 6/1924 | Cunneen . | |
| 3,636,996 | 1/1972 | Lanz . | |
| 3,772,784 | 11/1973 | Heermann . | |
| 3,949,817 | 4/1976 | Rice | 30/381 X |
| 4,060,894 | 12/1977 | Hampton . | |
| 4,447,953 | 5/1984 | Lombardino et al. . | |
| 4,658,507 | 4/1987 | Hazen | 30/382 |

*Primary Examiner*—Frank T. Yost
*Assistant Examiner*—Michael D. Folkerts
*Attorney, Agent, or Firm*—Robert W. Harris

[57] ABSTRACT

An anti-kickback safety structure comprising both a pivoting guard over the cutting chain and a pivotable, lockable support lever projecting to the rear from the chain saw housing, having a strap and belt for securing the support lever to the forearm of the operator. The support lever automatically provides a counter-torque to restrain a kickback when the cutting chain encounters a knot or other hard object when cutting wood, and also facilitates one-handed support of the chain saw by automatically countering the torque exerted by the weight of the chain saw.

13 Claims, 2 Drawing Sheets

CHAIN SAW SAFETY STRUCTURE

BACKGROUND OF THE INVENTION

The invention pertains generally to structures designed to minimize safety hazards to persons operating conventional chain saws.

It is well known that during the operation of a chain saw a hazard to the operator can arise, when the chain encounters a particularly hard object such as a knot or nail present in the wood being cut. The shock of this encounter may cause the saw to recoil upward and rearward toward the operator (hereinafter "kickback"), possibly causing serious injury to the operator.

One traditional approach to this problem has been to employ a guard, attached to the housing containing the chain saw motor, which guard normally lies in a position above and parallel to the cutting chain. Frequently this guard is pivotally attached to the housing, so that the guard will not impede the cutting operation, but instead may rotate away from the chain as the chain passes through the wood being cut and any surrounding foliage. In this arrangement a spring has been used, connecting the guard to the housing, to return the guard to its normal position after completion of each cutting operation.

One possible disadvantage of the guard is that it may in some cutting operations somewhat impede the operator's view of the cutting operation. There are some cutting operations in which it would be desirable to have an alternative safety mechanism to prevent kickback, so that the cutting operation could be performed without the guard of the type described above, to allow an unobstructed view of the cutting operation.

However, for maximum possible safety, it is desirable that the operator also have the option of using the guard in conjunction with the alternative safety mechanism. This mode of operation should be employed whenever the cutting operation is such that the guard does not present a significant view problem.

It is also desirable to have such an alternative safety mechanism which can not only prevent kickback, but can also allow the operator to adequately hold and control the chain saw with one arm, so that the operator's other hand is freed for other purposes—e.g., holding and positioning a branch or other object being cut, and controlling the fall thereof. Also such a mechanism allows the chain saw to be safely operated by a handicapped person having only one arm, or by a non-handicapped person of moderate strength.

The present invention deals with the above-described needs by providing an easily removable guard of simple design, together with a support lever projecting to the rear from the chain saw housing (the forward direction herein being the direction that the chain projects from the housing), which has a strap which bears upon the top of the forearm of the operator at the end of the support lever, so as to provide leverage against kickback; and also, in conjunction with the strap, a belt encircling the operator's forearm. This combination allows the operator to adequately hold and operate the chain saw with one arm.

SUMMARY OF INVENTION

The present invention is an anti-kickback safety structure intended for use with a conventional chain saw.

The principal components of the invention are a readily removable guard pivotally attached to the upper portion of the chain saw housing, projecting forward over the cutting chain, and a support lever projecting to the rear from the housing.

The guard is normally held in a position above and parallel to the cutting chain, by a pin and spring attached to the guard and to the housing. During a cutting operation the guard may pivot upward against the spring tension, as the cutting chain passes through the object being cut and any surrounding foliage, after which the spring returns the guard to the normal position. The guard serves to protect the operator from injury in the event of kickback.

The guard may easily be removed from the housing, such as for applications in which the guard may impede the operator's view of the cutting operation, by simply removing a pin which secures the guard to the housing.

The support lever is pivotally attached to the housing and in operation is rotated to a position extending rearward (toward the operator) from the housing, with the major portion of the support lever being essentially parallel to the cutting chain. The support lever locks in this operating position by means of a simple spring lock. Near the end of the support lever is a strap which rests upon the top of the operator's forearm, so that, in the event of a kickback, the operator's forearm exerts leverage through the strap and the support lever, strongly retarding the kickback motion, thus minimizing the safety hazard, even when the guard has been removed to facilitate a clear view of the cutting operation. A belt attached to the support lever at the position of the strap encircles the remainder of the operator's forearm, and allows the operator's forearm to bear a portion of the torque exerted by the weight of the chain saw, to facilitate one-handed operation. The support lever may easily be unlocked and folded under the chain saw for compactness in storage.

The principal purpose of the invention is to provide a simple, easily fabricated, inexpensive device which will protect the operator of a one-handed chain saw from injuries resulting from kickback, in a variety of cutting operations.

Another purpose of the invention is to provide such a device which can offer some protection to the operator from injury even in applications in which it is decided to remove the guard normally present above the cutting chain.

Another purpose of the invention is to provide such a device which will also allow the operator to hold the chain saw with one hand during cutting operations, so that the other hand will be free for other activities, e.g., holding the object to be cut, supporting oneself in a tree or other awkward position, etc.

Another purpose of the invention is to provide a device which will allow a handicapped, one-armed operator to operate a chain saw safely; something which such a person has heretofore not been able to do safely.

Another purpose of the invention is to provide a device which will help bear the torque exerted by the weight of the chain saw by the entire forearm instead of only the wrist, allowing persons of moderate strength to operate a one-handed chain saw.

Another purpose of the invention is to provide a device which may be compactly folded for storage in a minimum amount of space, between uses.

DESCRIPTION OF THE PREFERRED EMBODIMENT

Figure 1:
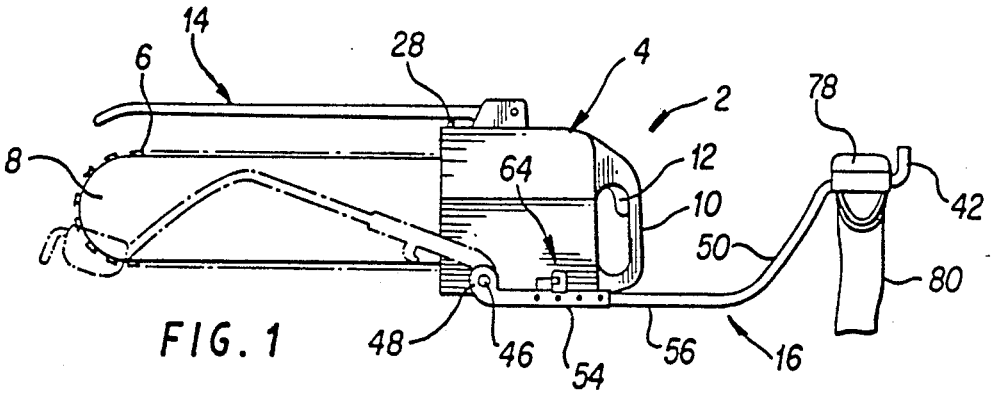
FIG. 1 is a side elevational view of the preferred embodiment of the present invention, shown connected to a conventional chain saw, in the operational configuration, also showing in phantom lines the support lever in the alternative storage or transport position, folded under the chain saw housing.

Referring now to the drawings, wherein like reference numbers denote corresponding parts, 2 denotes a conventional chain saw to which the present invention is attached. The chain saw 2 has a chain saw housing 4 containing the chain saw motor (not shown). Projecting from one end of the chain saw housing 4 is a cutting chain 6 which moves around the perimeter of a chain guide 8. On the opposite end of the chain saw housing 4 is a hand grip 10 with a finger switch 12 whereby the operator activates the chain saw motor. All of the components just named and numbered are parts of a conventional chain saw, but form no part of the present invention.

The principal components of the preferred embodiment of the present invention are a guard 14, pivotally connected to the top of the chain saw housing 4, and a support lever 16, pivotally connected to the lower portion of each side of the chain saw housing 4. The support lever 16 may be locked in the operational configuration of FIG. 1, in the manner described below.

Figure 2:
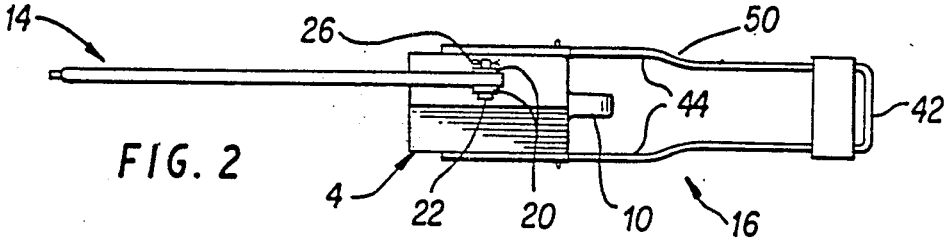
FIG. 2 is a plan view of the preferred embodiment, in the operational configuration of FIG. 1.
Figure 4:
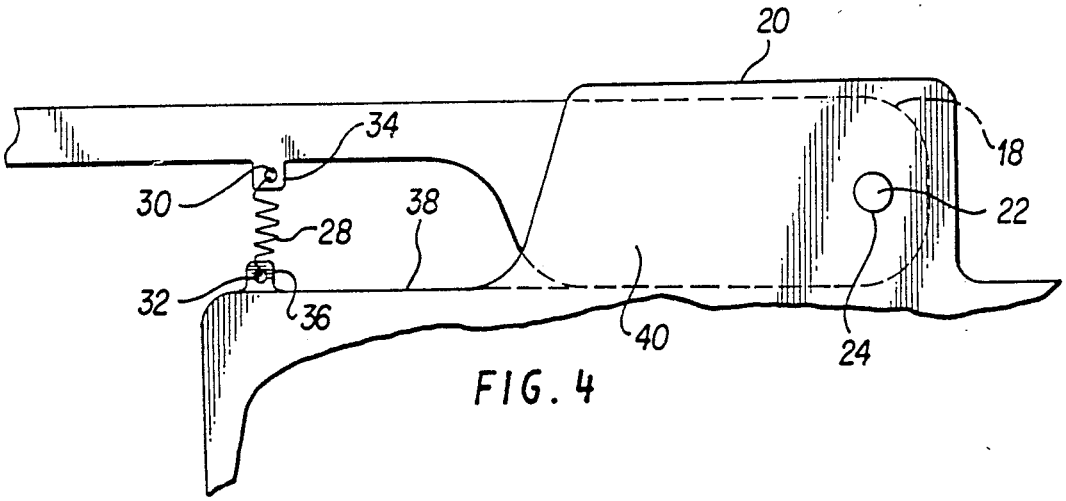
FIG. 4 is an enlarged side elevational view of the structure whereby the guard is pivotally attached to the chain saw housing.

As indicated in FIGS. 1 and 2, the guard 14 is in its normal operational configuration, before commencement of a cutting operation, located above and substantially parallel to the chain guide 8 and cutting chain 6. Of course, guard 14 must have a length and width substantially sufficient to cover the length and width of cutting chain 6 in the configuration shown in FIG. 1. The guard 14 may, however, pivot upward through an angle of up to approximately 90 degrees during a cutting operation, for example to allow the cutting chain 6 and chain guide 8 to completely pass through a large branch and thereafter return to its normal configuration, by means of a simple structure best illustrated in FIG. 4.

The end 18 of guard 14 is pivotally secured between two parallel bosses 20, by means of a pin 22 which engages matching holes 24 in the bosses 20 and the end 18. The pin 22 is secured in the position shown in the drawings by means of a cotter pin 26 which is inserted through a small hole (not shown) near one end of the pin 22. Pin 22 is flared at the end opposite the end having the hole for cotter pin 26, to prevent the flared end from slipping through holes 24. After the guard 14 pivots upward during a cutting operation due to encountering small branches, leaves, etc., the guard 14 is automatically returned to its normal configuration by the action of a spring 28, which is attached to holes 30 and 32 in two small bosses 34 and 36 located on the bottom of guard 14 and the top 38 of chain saw housing 4, respectively. The spring 28 is of a relaxed length less than the distance between the holes 30 and 32, and has a suitable force constant to securely hold the guard 14 in the normal configuration shown in FIG. 4. A broad flat boss 40 on the bottom near the end 18 of guard 14, having a bottom surface parallel to guard 14, engages the top surface 38 of chain saw housing 4 when spring 28 has returned the guard 14 to normal configuration of FIG. 4, thus stopping spring 28 from pulling guard 14 further downward onto cutting chain 6.

If it is desired to operate chain saw 2 without guard 14, guard 14 may be easily and quickly removed by simply removing cotter pin 26, withdrawing pin 22 from holes 24, and detaching spring 28 from hole 32.

Support lever 16 is a generally U-shaped member formed from metal tubing bent about the end 42 of support lever 16 to form two arms 44. The length of support lever 16 is slightly less than the length of the forearm of a typical operator, so that support lever 16 may extend to a point within about two inches of the operator's elbow, for purposes of obtaining good leverage for retarding kickback.

Each of arms 44 is pivotally attached to the lower sides of chain saw housing 4, near the front of chain saw housing 4. Arms 44 are attached to chain saw housing 4 by means of bolts 46 inserted through matching holes 48 in the ends of arms 44 and chain saw housing 4, which bolts 46 are secured by loosely fitting lock nuts (not shown) within chain saw housing 4.

Figure 3:
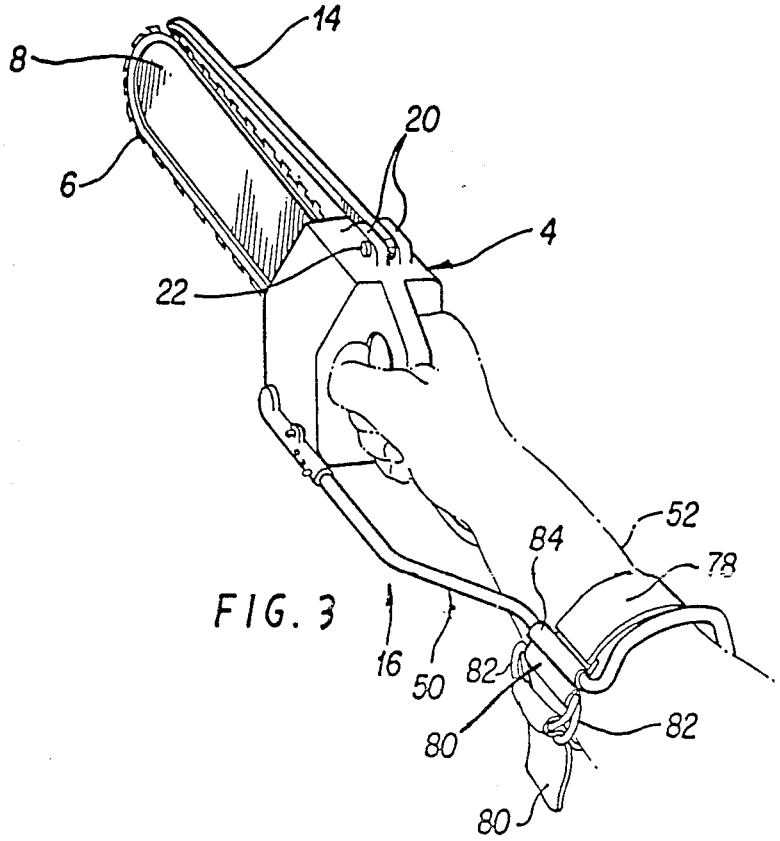
FIG. 3 is a perspective view showing the manner of attachment to the operator's forearm in the same configuration.

As best shown in FIGS. 1 and 2, the arms 44 of support lever 16 have a bend 50 in the mid portion of support lever 16, with the portions of arms 44 on either side of bend 50 being essentially parallel to one another. Bend 50 has two components. Bend 50 has a height (a component perpendicular to the general plane of the U-shape of support lever 16) about equal to the vertical thickness of the forearm of a typical operator (estimated typical thickness measured just below the elbow), and an inward bend component sufficient such that the lateral separation of arms 44 on the outer portion of support lever 16 is substantially equal to the forearm width of said typical operator (measured just below the elbow), while the lateral separation of arms 44 on the inner portion of support lever 16 (adjacent to chain saw housing 4) is equal to the width of chain saw housing 4. The amount of the inward bend depends upon how much the width of the chain saw housing 4 exceeds said forearm width; if the chain saw housing 4 is essentially no wider than said forearm width, no inward bend is necessary. As best shown in FIG. 3, the outer end 42 of support lever 16 is curved upward, about an axis lying generally along the axis of the U-shape of support lever 16, so that the end 42 of support lever 16 may rest above the top of the operator's forearm 52. This configuration allows the end 42 of support lever 16 to arch above the top of the forearm of the operator, as shown in FIG. 3.

Figure 6:
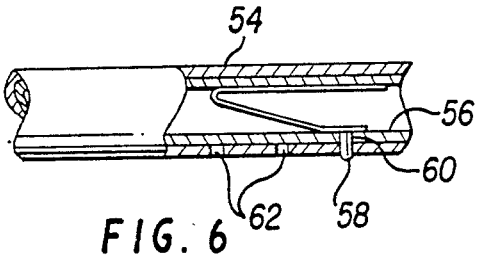
FIG. 6 is an enlarged view of a portion of the telescoping tubing of support lever, in partial section, showing a spring-biased locking pin whereby the length adjustment of the support may be locked at any of various lengths.
Figure 5:
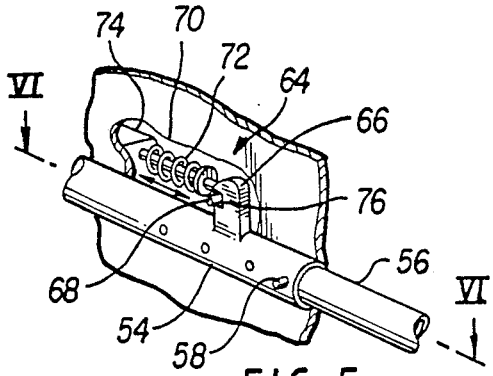
FIG. 5 is an enlarged perspective view of the spring lock whereby the support lever is locked in the operational configuration of FIG. 1, also showing the telescoping tubing structure whereby the length of the support lever may be adjusted.

As best seen in FIG. 1 and FIG. 5, the forward portions of each of arms 44 of support lever 16 is formed of telescoping tubing sections 54 and 56, so that the length of support lever 16 may be adjusted to accommodate the length of the forearm of a particular operator. As shown in FIG. 6, the length of support lever 16 may be set at any of various specific lengths by means of a spring-biased locking pin 58 which protrudes through a hole 60 in tubing section 56 and engages any of the regularly spaced holes 62 in tubing section 54.

Although the length of support lever 16 is adjustable to allow to some extent for variations in lengths of operator forearms, the width of the outer portion of support lever 16 is not so adjustable. In mass production said width would, as indicated above, be accommodated to an estimated typical width of an operator forearm. It is believed that variations of roughly ½ inch in forearm width would not pose a serious problem in operation of the invention. Alternatively, support lever 16 could, of course, be manufactured in varying sizes to better accommodate operators of varying forearm proportions.

In operation of the invention, support lever 16 is locked in the operational orientation shown in FIG. 1 (solid) and FIG. 3, by a spring lock 64 best illustrated in FIG. 5. Spring lock 64 comprises a latch hook 66 attached to the top of each tubing section 54 (on each arm 44 of support lever 16), and a latch pin 68 projecting through a slot 70 in each side of chain saw housing 4, which latch pin 68 is driven by a spring 72, being secured (with a limited longitudinal range of allowed motion) to an anchor block 74 attached to the inside wall of chain saw housing 4 (in FIG. 5 the slot 70 in the side of chain saw housing 4 is cut away to a larger size than necessary, to allow view of spring 72 and anchor block 74). The top of latch hook 66 is tapered so that when support lever 16 is rotated upward (counterclockwise in FIG. 1) toward the operational configuration, the tapered top of latch hook 66 will automatically move the outer end of latch pin 68 to the left in FIG. 5, compressing spring 72. When latch pin 68 clears the edge of latch hook 66, as support lever 16 is rotated upward, spring 72 automatically causes latch pin 68 to snap under the top of latch hook 66, into the locked position shown in FIG. 5, in which latch pin 68 is secured within a recess 76 in the side of latch hook 66. Recess 76 has an aperture just sufficient to receive latch pin 68 in a snug fit engagement. The operator may easily unlock each spring lock 64 (on each side of chain saw housing 4), when it is desired to rotate support lever 16 to the storage or transport position (FIG. 1 phantom view), by simply pushing the two latch pins 68 (securing each arm 44) forward (to the left in FIG. 5) until each clears its latch hook 66, and then rotating support lever 16 downward.

Figure 7:
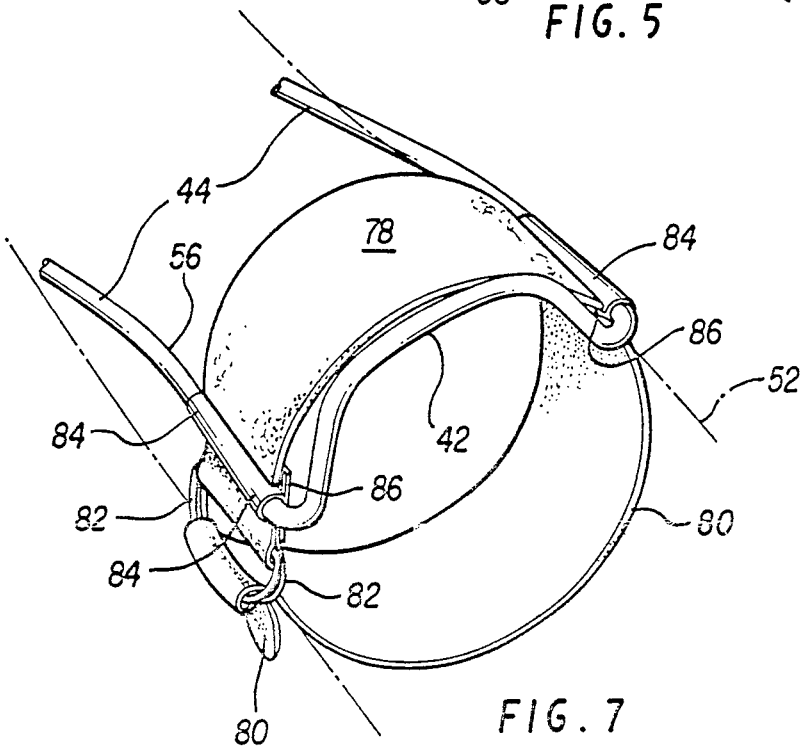
FIG. 7 is an enlarged perspective view of the outer end of the support lever, showing the manner of attachment of the strap and belt to the forearm of the operator.

Support lever 16 is secured to the forearm 52 of the operator, by a securing means, best shown in FIG. 7, which comprises a strap 78 traversing the top of the operator's forearm 52 between arms 44, and a belt 80 which encircles the remaining (lower) portion of the circumference of the operator's forearm 52. As best shown in FIGS. 3 and 7, belt 80 is in two sections which may be adjustably tightened about the operator's forearm 52 through cinching by means of D-rings 82. The ends of the two sections of belt 80 are secured to the tubing 56 of the arms 44 by means of loops 84 of the belt material through which the tubing of support lever 16 is passed. Short portions 86 of the belt material extend a short distance between the arms 44 of support lever 16, and strap 78 is attached to portions 86 by sewing or by a suitable adhesive. The two sections of belt 80 may each be formed of a single piece with the corresponding loops 84 from molded plastic, or separate belt and looped sections of cloth, leather or plastic may be joined by suitable adhesives or by sewing. Strap 78 is a comfortable strap of soft leather in the preferred embodiment.

Strap 78 and belt 80 perform different functions in the operation of the invention. When the cutting chain 6 of chain saw 2 encounters a hard object such as a knot during a cutting operation, so that cutting chain 6 recoils in a kickback toward the operator, the kickback involves a rotation of the entire chain saw 2 about a horizontal axis located roughly at the juncture of the operator's hand and hand grip 10, an axis perpendicular to the page in FIG. 1 (lying in the page in FIG. 2). The direction of rotation will be clockwise in FIG. 1. However, this rotation is prevented because strap 78 is resting upon the top of the operator's forearm 52, so that the operator's forearm 52 automatically stops the kickback, acting through strap 78 and support lever 16.

Belt 80 allows the operator to more easily hold the chain saw 2, by dealing with a torque problem. Since the center of gravity of the chain saw 2 is obviously located to the left of hand grip 10 in FIG. 1, the weight of chain saw 2 exerts a counterclockwise torque about a horizontal axis located at the position of hand grip 10 (the same axis just referred to regarding the kickback motion). However, since belt 80 rests upon the bottom of the operator's forearm 52, counterclockwise rotation is prevented. In other words, the operator's forearm 52 automatically exerts an equal and opposite (clockwise) torque, through belt 80 and support lever 16. Thus, belt 80 makes it easier for the operator to hold chain saw 2, since the operator does not have to provide such a counter torque through his wrist and hand, acting through a much shorter moment arm. Thus, belt 80 facilitates one-handed operation of chain saw 2.

The method of operation includes two alternative modes of operation. For maximum safety, the chain saw 2 is operated using both the guard 14, and the support lever 16 secured to the operator's forearm as described above. In this mode the support lever 16 should retard any kickback, but safety redundancy is afforded by guard 14 which shields the operator from cutting chain 6 even if support lever 16 and strap 78 somehow fail to retard a kickback. Alternatively, for applications in which it is desired to have an unobstructed view of the cutting operation, the operator may remove guard 14, and operate using only support lever 16 (secured to the operator's forearm as abovedescribed). This mode offers enhanced visibility at the sacrifice of the safety redundancy afforded by guard 14.

The components of the invention may be fabricated from well-known materials in a manner well known in the art. Guard 14 may be fabricated from metal by casting, or may be molded from a plastic of suitable strength. Support lever 16 is formed from sections of metal tubing of a diameter and wall thickness suitable to offer the requisite strength for retarding kickback. Of course, the strap 78, which is of leather in the preferred embodiment, must also be securely attached to the belt material short portions 86 by bonds of suitable strength, as by sewing or by a strong adhesive suitable for joining the strap and belt materials.

The components of spring lock 64 are fabricated of metal for optimum strength. Latch hook 66 is securely attached to tubing section 54, by welding or by casting tubing section 54 and latch hook 66 from a single piece.

Those familiar with the art will appreciate that the invention may be employed in configurations other than those specifically disclosed herein, without departing from the substance of the invention. For example, and not by way of limitation:

(1) Spring lock 64 is only one particular means for locking support lever 16 in the extended, operational position of FIG. 1. Various alternative means may be used instead to accomplish the same function. For example, a small tab having a hand-turned set screw could be attached to the side of each tubing section 54, and matching holes on each side of chain saw housing 4 could be used to receive said set screws for the purpose of locking support lever 16 in position.

(2) Strap 78, belt 80 and D-rings 82 together constitute a convenient means for securing support lever 16 to the forearm of the operator, but various alternative means may be used for this function. Instead of employing a separate strap and belt, one could employ a single belt completely encircling the operator's forearm 52 and attached to arms 44 of support lever 16. Instead of using a strap and/or belt, one might employ one or more cords attached to one of the arms 44, which could be looped around the operator's forearm 52 and then tied to small anchor posts on the opposite arm 44.

(3) D-rings 82 constitute a convenient means for securing the two sections of belt 80 and for adjusting the length of belt 80 to accommodate the size of a particular operator's forearm. However, the two sections of belt 80 could instead be joined by an array of hooks on the end of one of the belt sections, fitting matching holes in the end of the other section. By having a plurality of lines of holes at various positions along the length of the second belt section, length adjustment could be achieved.

(4) Spring-biased locking pin 58 and holes 62 and 60 in telescoping tubing sections 54 and 56, afford a means for adjusting the length of support lever 16 and locking the adjustment at a particular length. However, the length adjustment and locking could instead be accomplished by using an outer tube having at the end thereof a compression lock nut which could clamp the inner tube to lock the adjustment at a particular length.

(5) Wherever it is indicated herein that a component of the present invention is oriented "substantially" in a particular direction (e.g., parallel to another component, or having a horizontal orientation when the chain saw is operated with the chain guide held horizontally) it is to be understood that precise orientation in the indicated direction is ordinarily not required for satisfactory operation of the invention, and that the actual orientation may deviate from the indicated one by a few degrees, normally up to 5-10 degrees, depending on particular dimensions of particular embodiments of the invention.

The essential characteristics of the invention are defined in the following claims.

I claim:

1. Chain saw safety structure, for use by an operator of a chain saw having a chain saw housing containing a chain saw motor means for driving a cutting chain mounted upon the perimeter of a chain guide projecting from the forward end of said chain saw housing, for allowing said operator to readily and safely hold and operate said chain saw with one arm of said operator and for retarding kickback of said chain saw, said chain saw safety structure being hereinbelow described with reference to operation of said chain saw in a horizontal configuration of said chain guide although operation in said horizontal configuration is not necessary, comprising:

(a) support lever means, pivotally connected to said chain saw housing, having a principal longitudinal axis and having a length just slightly less than the length of the forearm of a typical operator of said chain saw, for allowing the forearm of said operator to exert leverage for retarding kickback of said chain saw;

(b) lock means, connected to said support lever means and to said chain saw housing, for locking said support lever means in a fixed orientation when said support lever means is rotated to the rear of said chain saw housing to an orientation in which the principal longitudinal axis of said support lever means is at least substantially parallel to said chain guide;

(c) securing means, connected to said support lever means, for securing said support lever means to the forearm of said operator.

2. Chain saw safety structure as in claim 1, further comprising:

(a) guard, connected to said chain saw housing at a location above said cutting chain; said guard having a length sufficient to cover the length of said cutting chain when said guard is oriented in an at least substantially horizontal position, and a width substantially sufficient to cover the width of said cutting chain;

(b) pivot means, connected to said guard and to said chain saw housing, for allowing said guard to pivot between a substantially horizontal position above said cutting chain, and a position inclined at an angle of up to approximately 90 degrees with respect to said cutting chain;

3. The chain saw safety structure as in claim 2, further comprising a return means, connected to said guard and to said chain saw housing, for returning said guard to a substantially horizontal configuration after said guard has pivoted upward during a cutting operation.

4. The chain saw safety structure as in claim 3, wherein said return means constitutes a spring attached to the bottom of said guard and to the top of said chain saw housing.

5. The chain saw safety structure as in claim 1, further comprising length adjustment means, connected to said support lever, for adjusting the length of said support lever means.

6. The chain saw safety structure as in claim 2, further comprising length adjustment means, connected to said support lever, for adjusting the length of said support lever means.

7. The chain saw safety structure as in any one of the preceding claims, wherein said lock means comprises at least one latch hook attached to said support lever means, said latch hook having a top which is tapered in a direction substantially parallel to the principal longitudinal axis of said support lever means, said latch hook having a recess below the short end of said latch hook adapted to receive a latch pin; a latch pin, connected to said chain saw housing within said chain saw housing by an anchor block means for holding said latch pin in a substantially horizontal position and for allowing said latch pin to move horizontally within a limited range, said latch pin having an end portion which projects at right angles through a slot in the side of said chain saw housing, said latch pin and anchor block means being so positioned on the side of said latch hook toward which said latch hook tapers, that said end portion of said latch pin may move into said recess of said latch hook when said support lever means is extended to a substantially horizontal position to the rear of said chain saw housing; and a spring means, surrounding the principal portion of said latch pin, for urging said latch pin to the fully extended position.

8. The chain saw safety structure as in any of claims 1–6 wherein said support lever means comprises a support lever formed of tubing substantially configured in the shape of a U, namely having two portions of said tubing forming two substantially parallel arms constituting the sides of said U, said arms being joined by another portion of said tubing forming the base of said U, wherein said arms of said support lever are pivotally attached to the lower portions of the two opposite sides of said chain saw housing.

9. The chain saw safety structure of claim 8, wherein said support lever has a bend substantially in the mid portion of said U such that the portion of said U adjacent to the base of said U is in a plane substantially parallel to but displaced from the plane of the portion of said U opposite to the base of said U, said bend being formed by bends in the two arms of said support lever substantially in the mid-portion of said support lever, said bends having a first component in a direction lying in a plane substantially perpendicular to the plane of each portion of said U, with the direction of said first component of said bends being such that when said support lever is extended to a generally horizontal position behind said chain saw housing, the portions of said arms of said support lever on the side of said bend opposite said chain saw housing are at a higher elevation than the portions of said arms adjacent to said chain saw housing, with the portions of said arms of said support lever on either side of said bend all being substantially parallel to one another, and with the first component of said bends in said arms having a vertical height, when said support lever is oriented in a generally horizontal position, about equal to the forearm thickness of a typical operator measured just below the elbow; said bends also having a second inward component substantially parallel to the plane of each portion of said U, in the direction and with a magnitude such that the lateral separation of said arms of said support lever in the portion of said support lever adjacent to the base of said U is substantially commensurate with the width of the forearm of a typical operator, while the lateral separation of said arms of said support lever in the portion of said support lever opposite said base of said U is equal to the width of said chain saw housing; and wherein the outer end of said support lever is curved upward, in the same direction as said first component of said bend of said arms of said support lever, about an axis lying generally along the axis of the portion of said U shape adjacent to said base of said U, sufficiently so as to arch over the forearm of said operator.

10. The chain saw safety structure of claim 8, wherein said securing means comprises a strap means, connected to said arms of said support lever near the end of said support lever opposite said chain saw housing, for comfortably resting said support lever against the top of the forearm of said operator; and belt means, connected to said arms of said support lever near the end of said support lever opposite said chain saw housing, for encircling the remainder of said forearm of said operator not encircled by said strap means, said belt means further comprising means for adjustment of the length of said belt means.

11. The chain saw safety structure of claim 8, wherein said securing means comprises a single belt means, attached to said arms of said support lever near the end of said support lever opposite said chain saw housing, for completely encircling the forearm of said operator and for securing said forearm of said operator to said arms of said support lever.

12. The chain saw safety structure as in either claim 5 or claim 6, wherein said length adjustment means comprises telescoping sections of said support lever means, having larger and smaller diameters adapted to a snug fit engagement, and a length-locking means, connected to said telescoping sections of said support lever means, for locking the relative longitudinal orientations of said telescoping sections at a position corresponding to a desired length of said support lever means.

13. The chain saw safety structure of claim 11, wherein said length-locking means comprises a spring-biased lock pin secured within the interior of said smaller diameter section of said support lever means, said smaller diameter section of said support lever means having a hole in the side of said smaller diameter section of said support lever means at the position of said spring-biased locking pin, said hole having a diameter equal to the diameter of said spring-biased locking pin, said larger diameter section of said support lever means having a plurality of longitudinally spaced holes of diameter equal to the diameter of said spring-biased locking pin, angularly positioned at the same angular position as said spring-biased locking pin.

* * * * *